US006536249B2

(12) United States Patent
Wu

(10) Patent No.: US 6,536,249 B2
(45) Date of Patent: Mar. 25, 2003

(54) LOCK DEVICE THAT MAY BE LOCKED AUTOMATICALLY

(75) Inventor: Wen-Bin Wu, Kaohsiung Hsien (TW)

(73) Assignee: Taiwan Fu Hsing Industrial Co., Ltd., Kaohsiung Hsien (TW)

( * ) Notice: Subject to any disclaimer, the term of this patent is extended or adjusted under 35 U.S.C. 154(b) by 0 days.

(21) Appl. No.: 10/134,527

(22) Filed: Apr. 30, 2002

(65) Prior Publication Data

US 2002/0162368 A1 Nov. 7, 2002

(30) Foreign Application Priority Data

May 2, 2001 (TW) ..... 90207222 U

(51) Int. Cl.[7] ..... E05B 13/10

(52) U.S. Cl. ..... 70/467; 70/151 R; 70/215; 70/224

(58) Field of Search ..... 70/210, 215–217, 70/221–224, 467, 468, 150, 151 R, 475–485

(56) References Cited

U.S. PATENT DOCUMENTS 5,113,675 A * 5/1992 Uyeda ..... 70/477
5,372,025 A * 12/1994 Lin ..... 70/472
5,868,018 A * 2/1999 Kang ..... 70/472
5,927,777 A * 7/1999 Kuo et al. ..... 70/224 X
5,934,117 A * 8/1999 Shen ..... 70/224
5,941,108 A * 8/1999 Shen ..... 70/467
6,085,561 A * 7/2000 Yao ..... 70/472
6,101,856 A * 8/2000 Pelletier et al. ..... 70/472
6,360,569 B1 * 3/2002 Huang ..... 70/215
6,470,721 B2 * 10/2002 Ming ..... 70/224

* cited by examiner

*Primary Examiner*—Lloyd A. Gall
(74) *Attorney, Agent, or Firm*—Bacon & Thomas, PLLC

(57) ABSTRACT

A lock device that may be locked automatically includes a base fixed on a door plate. An actuating tube received in the hole of the base is provided with a locking member combined with a handle. The lock core unit has a lock core that may drive an actuating plate to rotate. The drive wheel has a drive slot for insertion of the actuating plate, so that the drive wheel and the actuating plate may be rotated simultaneously. An elastic member has two stop ends rested on the leg of the restoring wheel, and rested on the two sides of the ear plate of the locking plate. The drive plate has a first end inserted into an unlocking rotation knob of the other side of the door plate, and a second end inserted into the drive slot of the drive wheel.

3 Claims, 4 Drawing Sheets

LOCK DEVICE THAT MAY BE LOCKED AUTOMATICALLY

BACKGROUND OF THE INVENTION

1. Field of the Invention

The present invention relates to a lock device that may be locked automatically, and more particularly to a lock device that is available for a special site needing an automatic locking function, such as a warehouse, a waterproof door or the like, thereby providing a better safety.

2. Description of the Related Art

A conventional handle type lock device in accordance with the prior art shown in FIG. 1 is available for a warehouse, a waterproof door or the like, and comprises a seat 90, and a handle 91 rotatably mounted on the seat 90. Rotation of the handle 91 may drive an actuating tube 92 and a drive tube 94 to rotate. The drive tube 94 may drive the lock tongue of the lock latch to extend outward or retract inward (not shown). The actuating tube 92 has a distal end combined with a restoring spring seat 93. When the force for driving the handle 91 to rotate is removed, the restoring spring seat 93 may drive the actuating tube 92 and the handle 91 to rotate to return the original position. The locking and unlocking of the lock device may be operated by a correct key to drive a drive plate 95 to rotate. The drive plate 95 may press the locking plate 96 to extend outward or retract inward in the positioning hole 921 of the actuating tube 92. When the locking plate 96 is protruded outward from the positioning hole 921 of the actuating tube 92, the locking recess 961 of the locking plate 96 may be locked on the lug 971 of the fixing plate 97, so that the actuating tube 92 and the handle 91 cannot be rotated. When the locking plate 96 is retracted into the positioning hole 921 of the actuating tube 92, the locking recess 961 of the locking plate 96 may be detached from the lug 971 of the fixing plate 97, so that the actuating tube 92 may be driven by the handle 91 to rotate.

However, when the conventional handle type lock device is locked or unlocked, the user needs to use a correct key to drive a drive plate 95 to rotate. Thus, if the conventional handle type lock device is used in the site, such as the warehouse, that needs to be locked constantly, the conventional handle type lock device is inconvenient in use, and may be unlocked unintentionally.

SUMMARY OF THE INVENTION

The primary objective of the present invention is to provide a lock device that may be locked automatically, wherein after the lock device is opened by a correct key, when the rotation force on the correct key is removed, the key may be returned to a detachable state automatically. Thus, when the door plate is closed, the oblique face of the lock tongue may slide into the retaining plate of the door frame, and the lock device may be locked automatically.

In accordance with the present invention, there is provided a lock device that may be locked automatically, comprising:

a base, fixed on a door plate, the base formed with a hole and having a periphery formed with locking recesses;

an actuating tube, provided with a locking member combined with a handle, and having a first end for receiving a locking plate and a second end formed with a straight slot for combination of a lock core unit, the locking plate being provided with protruding ear plates that may protrude from a straight slot formed in the first end of the actuating tube, the ear plates being locked in the locking recesses of the base, so that the actuating tube cannot be rotated relative to the base;

a lock core unit, received in the second end of the actuating tube, and provided with a side wall portion that may be locked in the straight slot of the second end of the actuating tube, the lock core unit having a lock core that may be driven by a correct key to rotate, the lock core capable of driving an actuating plate to rotate;

a drive wheel, placed in the actuating tube, and having a drive slot for insertion of the actuating plate of the lock core unit, so that the drive wheel and the actuating plate of the lock core unit may be rotated mutually;

a restoring wheel, placed in the actuating tube, and having a mounting hole for passage of the drive plate, the restoring wheel having legs, so that the two stop ends of an elastic member may be rested on one of the legs, and the two stop ends of the elastic member may be rested on the two sides of one of the ear plates of the locking plate; and a drive plate, having a first end passed through a driving wheel of a lock latch and inserted into an unlocking rotation knob of the other side of the door plate, and a second end inserted into the drive slot of the drive wheel.

Further benefits and advantages of the present invention will become apparent after a careful reading of the detailed description with appropriate reference to the accompanying drawings.

DETAILED DESCRIPTION OF THE PREFERRED EMBODIMENTS

Figure 1:
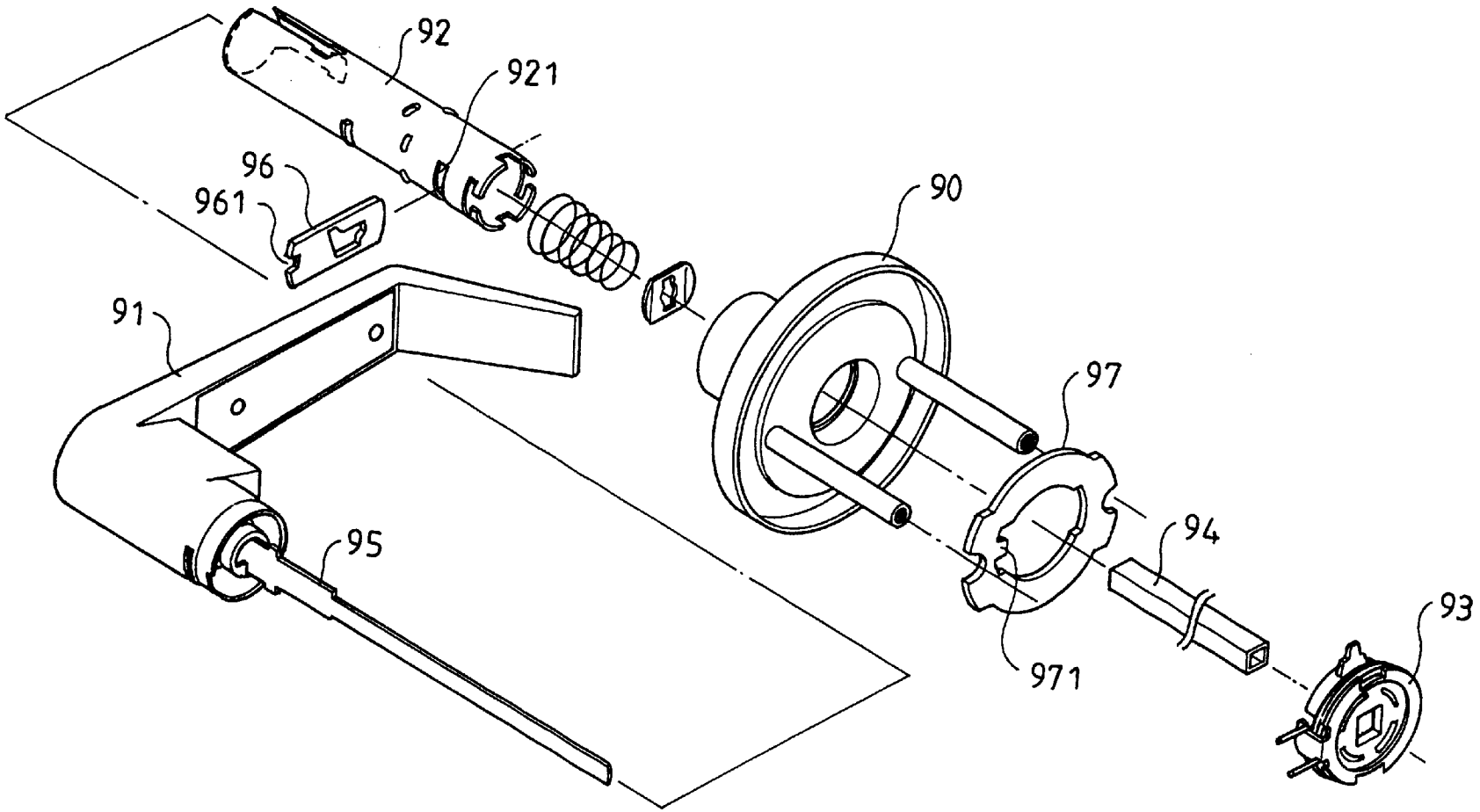
FIG. 1 PRIOR ART
FIG. 1 is an exploded perspective view of a conventional handle type lock device in accordance with the prior art.
Figure 2:
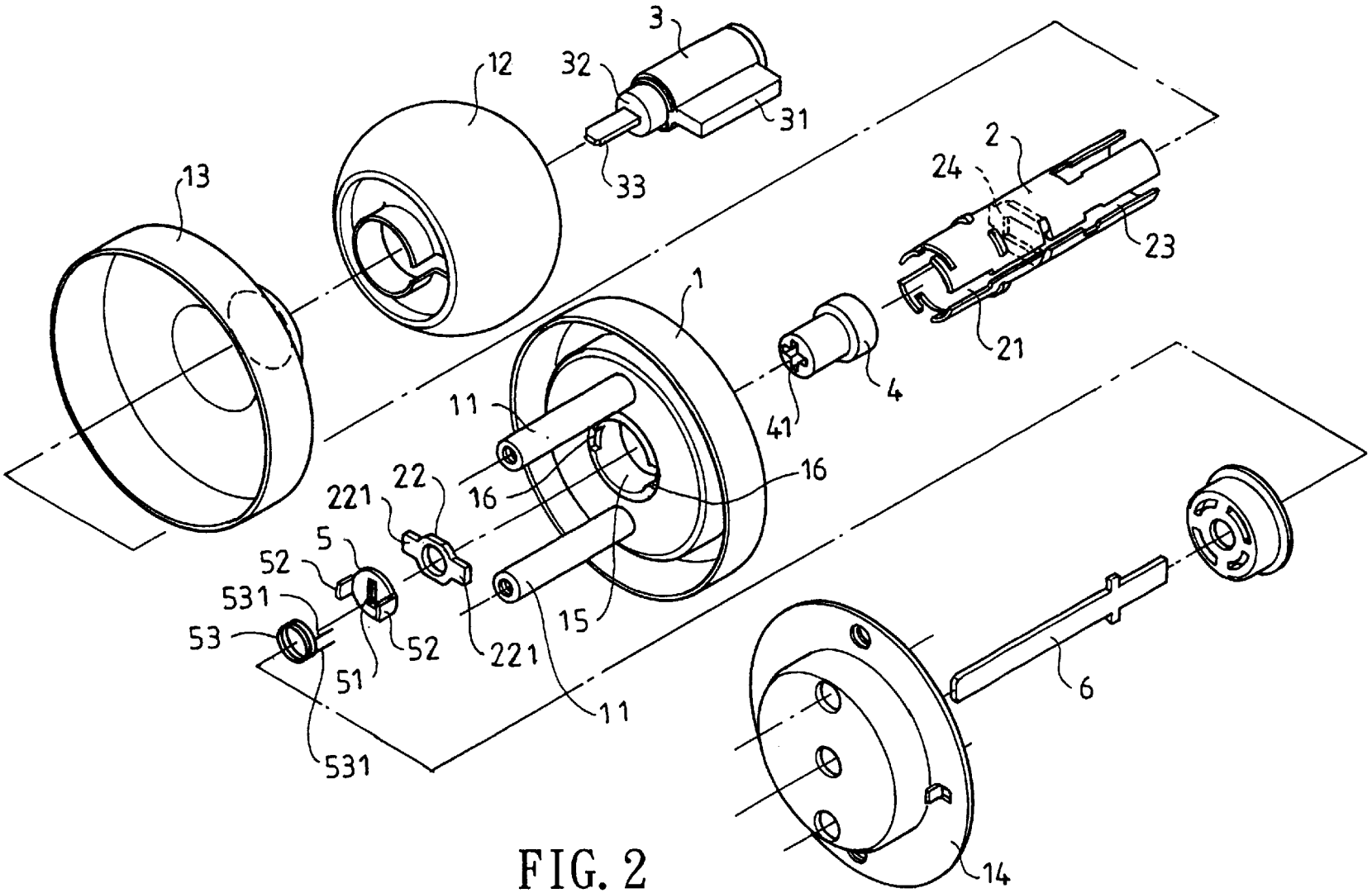
FIG. 2 is an exploded perspective view of a lock device that may be locked automatically in accordance with a preferred embodiment of the present invention.

Referring to the drawings and initially to FIG. 2, a lock device that may be locked automatically in accordance with a preferred embodiment of the present invention comprises a base 1, an actuating tube 2, a lock core unit 3, a drive wheel 4, a restoring wheel 5, and a drive plate 6.

The base 1 is provided with posts 11 that may be fixed at a proper position of the door plate. The base 1 may be combined with a fixed handle 12 that cannot be rotated. The handle 12 may be drawn by the door plate. If necessary, the base 1 may be combined with a decorative cover 13 and a bottom cover 14, thereby enhancing the outer appearance of the base 1. The base 1 is formed with a hole 15 for passage of the actuating tube 2. The hole 15 of the base 1 has a periphery formed with locking recesses 16.

The actuating tube 2 is placed in the hole 15 of the base 1, and has a first end formed with a straight slot 21, so that the ear plates 221 of the locking plate 22 may protrude from the straight slot 21 of the actuating tube 2. In addition, the ear plates 221 of the locking plate 22 are locked in the locking recesses 16 of the base 1, so that the actuating tube 2 cannot be driven by the handle 12 to rotate. The first end of the actuating tube 2 may be used to receive the drive wheel 4, the restoring wheel 5 and the drive plate 6 therein. The second end of the actuating tube 2 may be used to receive the lock core unit 3 therein. The second end of the actuating tube 2 is formed with a straight slot 23, so that the side wall portion 31 of the lock core unit 3 may be locked in the straight slot 23 of the actuating tube 2, for retaining the lock core unit 3 in position.

The lock core unit 3 is received in the second end of the actuating tube 2, and is provided with a side wall portion 31 that may be locked in the straight slot 23 of the actuating tube 2, for retaining the lock core unit 3 in position. The lock core unit 3 has a lock core 32 that may be driven by a correct key to rotate. The lock core 32 has an end face combined with an actuating plate 33 that may be rotated synchronously. The actuating plate 33 of the lock core unit 3 is extended into the drive slot 41 of the drive wheel 4, for driving the drive wheel 4 to rotate.

The drive wheel 4 is placed in the actuating tube 2, and has a drive slot 41. In the preferred embodiment of the present invention, the drive slot 41 of the drive wheel 4 preferably has a cruciform shape. The drive slot 41 of the drive wheel 4 has a first end for insertion of the actuating plate 33 of the lock core unit 3, and a second end for insertion of the drive plate 6, so that the actuating plate 33, the drive wheel 4 and the drive plate 6 may be rotated synchronously.

The restoring wheel 5 is placed in the actuating tube 2, and has a mounting hole 51 which has a cross-section mating with the drive plate 6. The restoring wheel 5 has two extending legs 52, so that the two stop ends 531 of an elastic member 53 may be locked on the two ends of the leg 52 respectively. In addition, the two stop ends 531 of the elastic member 53 are rested on the two sides of the ear plate 221 of the locking plate 22. Thus, after the force for driving the restoring wheel 5 to rotate is removed, the restoring wheel 5 may be driven by the elastic member 53 to return to the original position.

The drive plate 6 is a locking control device for connecting the inner side and the outer side of the door plate. In the preferred embodiment of the present invention, the drive plate 6 has a first end combined with the unlocking rotation knob (not shown) of the inner side of the door plate, and a second end inserted into the drive slot 41 of the drive wheel 4, so that the drive wheel 4 may be driven by the drive plate 6 to rotate. In addition, the drive wheel 4 may also be driven by the actuating plate 33 of the lock core unit 3 to rotate.

Figure 3:
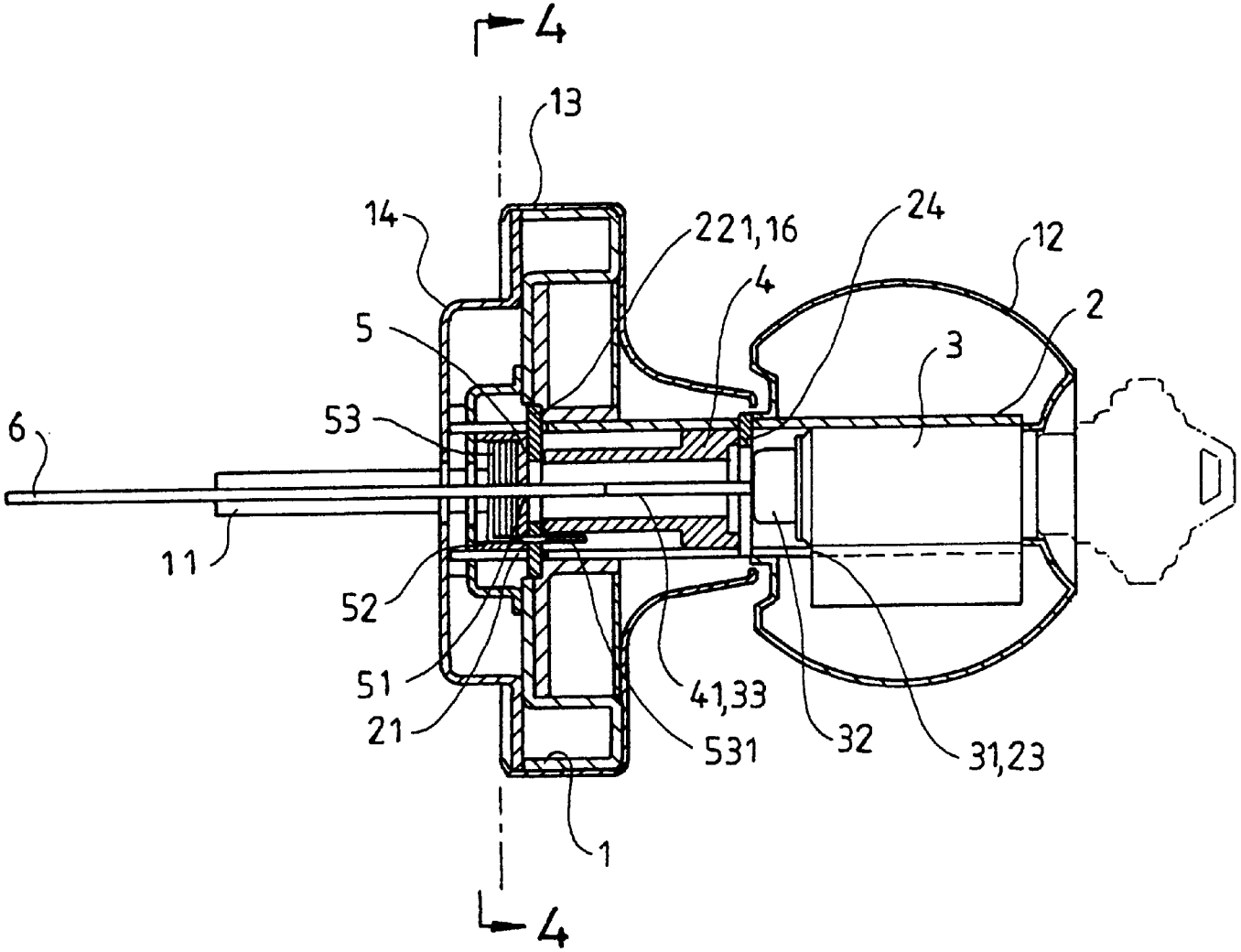
FIG. 3 is a plan cross-sectional assembly view of the lock device that may be locked automatically as shown in FIG. 2.

Referring to FIG. 3, the lock device that may be locked automatically in accordance with the preferred embodiment of the present invention is assembled. The base 1 is rested on the outer side of the door plate, and the posts 11 may be locked by positioning members from the outer side of the door plate. The base 1 is combined with the handle 12 and the actuating tube 2. The actuating tube 2 is provided with a locking member 24 that is locked in the handle 12, so that the handle 12 cannot be detached. The two ends of the actuating tube 2 may receive the lock core unit 3, the drive wheel 4, the restoring wheel 5, the drive plate 6 and the locking plate 22 therein. In addition, the ear plates 221 of the locking plate 22 are locked in the locking recesses 16 of the base 1, so that the handle 12 and the actuating tube 2 cannot be rotated relative to the base 1. The drive slot 41 of the drive wheel 4 has a first end for insertion of the actuating plate 33 of the lock core unit 3, and a second end for insertion of the drive plate 6. In addition, the drive plate 6 has a first end combined with the unlocking rotation knob (not shown) of the inner side of the door plate, and a second end passed through the drive wheel of the lock latch. The drive plate 6 is also passed through the mounting hole 51 of the restoring wheel 5.

Figure 4:
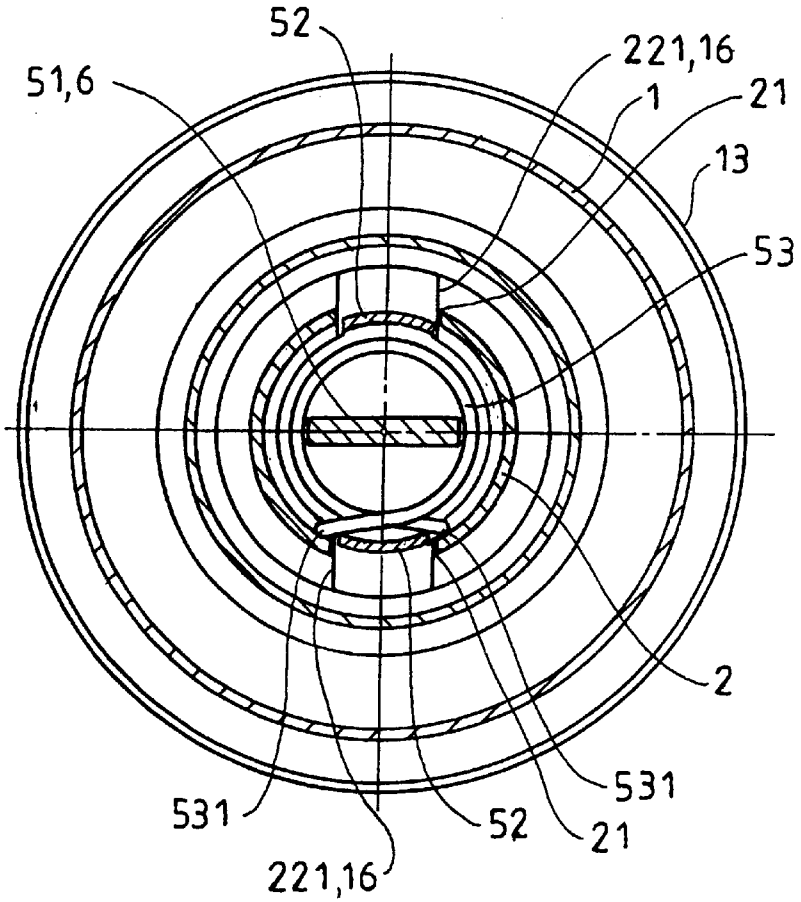
FIG. 4 is a cross-sectional view of the lock device that may be locked automatically taken along line 4—4 as shown in FIG. 3.

Referring to FIG. 4, the lock device that may be locked automatically in accordance with the preferred embodiment of the present invention is locked. At this time, the drive plate 6 is disposed at a horizontal state (according to the plane of the figure), and is not rotated. At this time, the two stop ends 531 of the elastic member 53 are urged on one of the two legs 52 of the restoring wheel 5, and are rested on the two sides of one of the two ear plates 221 of the locking plate 22.

Figure 5:
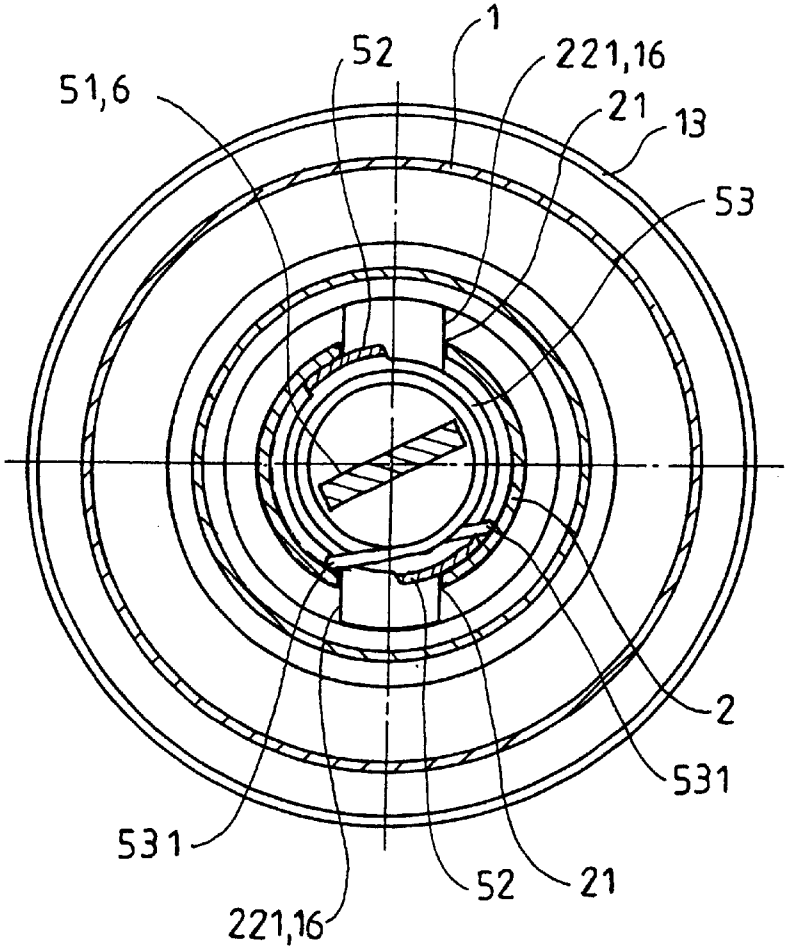
FIG. 5 is a schematic operational view of the lock device that may be locked automatically as shown in FIG. 4.

Referring to FIG. 5, when the door plate is to be opened, the unlocking rotation knob (not shown) of the inner side of the door plate may be rotated directly, whereby the drive plate 6 may be driven to rotate, so that the lock tongue of the lock latch may be retracted inward. In addition, the lock core 32 of the lock core unit 3 may be driven to rotate by a correct key from the outer side of the door plate. Thus, the lock core 32 of the lock core unit 3 may drive the actuating plate 33 to rotate, and the actuating plate 33 of the lock core unit 3 may drive the drive wheel 4 to rotate. Thus, the drive plate 6 inserted into the drive wheel 4 may be driven to rotate, so that the lock tongue of the lock latch may be retracted inward. At this time, the restoring wheel 5 is also driven to rotate. Thus, the two stop ends 531 of the elastic member 53 may be pressed by one of the two legs 52 of the restoring wheel 5, so that the restoring wheel 5 may be retracted.

When the force exerted on the unlocking rotation knob (not shown) of the inner side of the door plate to drive and rotate the drive plate 6 is removed, or when the force exerted by the correct key from the outer side of the door plate to drive and rotate the lock core 32 of the lock core unit 3 is removed, the two stop ends 531 of the elastic member 53 may push the leg 52 of the restoring wheel 5, so that the retracted restoring wheel 5 may be rotated and restored. Thus, the drive plate 6 and the actuating plate 33 of the lock core unit 3 may also be returned to the original position as shown in FIG. 4. Thus, once the force exerted on the unlocking rotation knob (not shown) of the inner side of the door plate to drive and rotate the drive plate 6 is removed, or once the force exerted by the correct key from the outer side of the door plate to drive and rotate the lock core 32 of the lock core unit 3 is removed, the door plate may be returned to the closed position (by use of a door bow, and when the oblique conic face of the lock tongue is pressed on the retaining plate fixed on the door frame, the lock tongue may be retracted automatically), so that the lock device may be locked automatically. Thus, the lock device in accordance with the preferred embodiment of the present invention may be locked automatically.

Accordingly, the lock device that may be locked automatically in accordance with the preferred embodiment of the present invention is available for a warehouse, a waterproof door or the like, so that when the door plate is closed at the position of the door frame, the door may be locked automatically. Thus, the lock device that may be locked automatically in accordance with the preferred embodiment of the present invention is available for a special site needing an automatic locking function, thereby providing a better safety.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A lock device that may be locked automatically, comprising:

a base, fixed on a door plate, the base formed with a hole and having a periphery formed with locking recesses;

an actuating tube, provided with a locking member combined with a handle, and having a first end for receiving a locking plate and a second end formed with a straight slot for combination of a lock core unit, the locking plate being provided with protruding ear plates that may protrude from a straight slot formed in the first end of the actuating tube, the ear plates being locked in the locking recesses of the base, so that the actuating tube cannot be rotated relative to the base;

a lock core unit, received in the second end of the actuating tube, and provided with a side wall portion that may be locked in the straight slot of the second end of the actuating tube, the lock core unit having a lock core that may be driven by a correct key to rotate, the lock core capable of driving an actuating plate to rotate;

a drive wheel, placed in the actuating tube, and having a drive slot for insertion of the actuating plate of the lock core unit, so that the drive wheel and the actuating plate of the lock core unit may be rotated simultaneously;

a restoring wheel, placed in the actuating tube, and having a mounting hole for passage of the drive plate, the restoring wheel having legs, so that the two stop ends of an elastic member may be rested on one of the legs, and the two stop ends of the elastic member may be rested on the two sides of one of the ear plates of the locking plate; and a drive plate, having a first end passed through a driving wheel of a lock latch and inserted into an unlocking rotation knob of the other side of the door plate, and a second end inserted into the drive slot of the drive wheel.

2. The lock device that may be locked automatically as claimed in claim 1, wherein the base is provided with posts for combination of positioning members from the other side of the door plate.

3. The lock device that may be locked automatically as claimed in claim 1, wherein the drive slot of the drive wheel has a cruciform shape.

* * * * *